United States Patent [19]

Morgan

[11] Patent Number: 4,592,427

[45] Date of Patent: Jun. 3, 1986

[54] THROUGH TUBING PROGRESSING CAVITY PUMP

[75] Inventor: Arvid E. Morgan, Claremore, Okla.

[73] Assignee: Hughes Tool Company, Houston, Tex.

[21] Appl. No.: 622,330

[22] Filed: Jun. 19, 1984

[51] Int. Cl.[4] ..... E21B 43/00; F04C 1/06

[52] U.S. Cl. ..... 166/369; 418/48

[58] Field of Search ..... 166/369, 186, 196, 106, 166/107; 418/48; 464/18

[56] References Cited

U.S. PATENT DOCUMENTS 2,739,650 3/1956 Hill ..... 166/106

3,347,169 10/1967 Cronin, Jr. et al. ..... 418/48

FOREIGN PATENT DOCUMENTS 2645933 4/1978 Fed. Rep. of Germany ..... 418/48

*Primary Examiner*—Stephen J. Novosad

*Assistant Examiner*—Thuy M. Bui

*Attorney, Agent, or Firm*—James E. Bradley

[57] ABSTRACT

A progressing cavity pump has features that allow it to be installed through tubing in a well. The pump has a stator and a helical rotor located in the stator. The rotor is rotated by a string of sucker rods that extends through the tubing to the surface. The tubing has a tubular seating member located at the lower end. A seating member is secured also to the lower end of the stator for reception in the seating member of the tubing. The seating members cooperate to prevent rotation of the stator and sealing. A rotor nipple extends above the stator and contains a drive rod which is connected between the sucker rod and the rotor. The rotor nipple has a restraining collar, and the drive rod has couplings located above and below the collar and spaced apart a selected distance to allow some vertical movement of the rotor with respect to the stator.

4 Claims, 2 Drawing Figures

THROUGH TUBING PROGRESSING CAVITY PUMP

BACKGROUND OF THE INVENTION

1. Field of the Invention

This invention relates in general to progressing cavity pumps, and in particular to a progressing cavity pump installation in a well through tubing and using sucker rods for driving the pump.

2. Background of the Invention

A progressing cavity pump is a well known pump, frequently called a "Moineau" pump, that has an elastomeric outer element or stator. The stator has a double lead helix in its inner surface. A metal rotor having a single lead helical exterior inserts within the stator. When the rotor is rotated, it causes fluid to pump through the stator.

Progressing cavity pumps of this type are used for many purposes, particularly for pumping viscous liquids. These pumps are also used as oil well pumps. When used as an oil well pump, the stator is secured to the lower end of the well tubing, then lowered into the casing of the well. The rotor is secured to the lower end of the sucker rod and lowered through the tubing to position the rotor inside the stator. The sucker rod is rotated by means of a rotary power source at the surface. U.S. Pat. No. 2,267,459 shows one type of installation for an oil pump.

One disadvantage is that if the stator needs to be serviced, the string of tubing must be pulled. This is time consuming and requires special equipment. U.S. Pat. No. 3,347,169 shows a progressing cavity pump installation wherein the stator is lowered through the tubing on a flexible drive cable and secured by a seat.

SUMMARY OF THE INVENTION

The progressing cavity pump of this invention is lowered through tubing on a string of sucker rods. The tubing has a seating member secured to its lower end. The stator has a seating member mounted below for reception in the tubing seating member. The rotor is secured to a drive rod, which in turn is secured to a string of sucker rods. The drive rod is located within a tubular rotor nipple which has a restraining collar located therein. The drive rod has flange means spaced apart which will not pass through the restraining collar, allowing the stator to be lowered on the sucker rod. Once seated, the sucker rod and rotor are pulled up a few inches to allow for rod stretch.

DESCRIPTION OF THE PREFERRED EMBODIMENT

Figure 1:
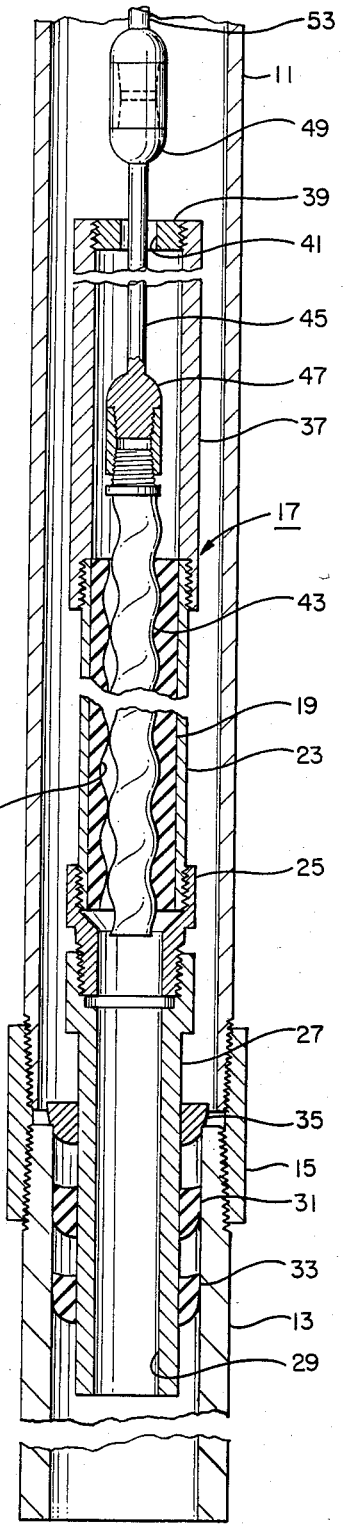
FIG. 1 is a vertical sectional view illustrating a progressing cavity pump constructed in accordance with this invention, shown in the set position in the tubing.

Referring to FIG. 1, a string of tubing 11 is shown. The tubing 11 will normally be located within casing (not shown) in a well. A seating nipple 13 is secured to the lower end of tubing 11. Seating nipple 13 is a tubular member having a smooth, cylindrical inner diameter that is less than the inner diameter of the tubing 11.

Seating nipple 13 is secured by a sleeve 15 to the lower end of tubing 11.

A progressing cavity pump 17 is shown in FIG. 1 in the seated position. Pump 17 includes a stator 19, which is elastomeric and has undulations 21 in its interior. Stator 19 is located within a metal stator housing 23.

An adapter 25 is secured to the lower end of housing 23. Adapter 25 has a lower end of lesser diameter than its upper end and which is secured to a seating member 27. Seating member 27 is a metal tube having a bore 29 therethrough for the passage of well fluid. Seating member 27 has on its exterior two axially spaced-apart annular cup seals 31 and 33. Seals 31 and 33 have a diameter that is larger than the inner diameter of seating nipple 13 for sealing the seating member 27 therein. A torque reactor cup 35 is located above the seals 31 and 33. Torque reactor cup 35 is of hard metal and has a frusto-conical exterior for wedging within the upper end of the tubing seating nipple 13. Torque reactor cup 35 serves to prevent rotation of the seating member 27. The outer diameters of seals 31 and 33 and torque reactor cup 35 are less than the inner diameter of tubing 11, providing a clearance for the passage of well fluid while the pump 17 is being lowered into the well.

The upper end of the stator housing 23 is secured to a rotor nipple 37. Nipple 37 is a cylindrical tube with an inner diameter approximately that of the inner diameter of stator housing 23. Rotor nipple 37 has a restraining collar 39 mounted at its upper end. Collar 39 is secured by threads and has an axial aperture 41 therethrough.

A helical metal rotor 43 having a length greater than stator 19 is adapted to be located inside stator 19. Rotor 43 and stator 19 are of conventional design. The upper end of rotor 43 is secured to a drive rod 45. Drive rod 45 extends loosely through the aperture 41, providing a clearance for well fluid to be pumped through aperture 41. Drive rod 45 has a lower coupling 47 which connects the drive rod 45 to the rotor 43. An upper coupling 49, located above collar 39 connects the drive rod 45 to a string of sucker rods 53. The couplings 47 and 49 are larger in diameter than aperture 41 and are spaced axially apart about 10 to 15 inches. The spacing is greater than the expected amount that the sucker rods 53 will stretch when the tubing 11 is full of well fluid. The sucker rod string 53 comprises rigid rods connected together in customary lengths and extending to the surface.

Figure 2:
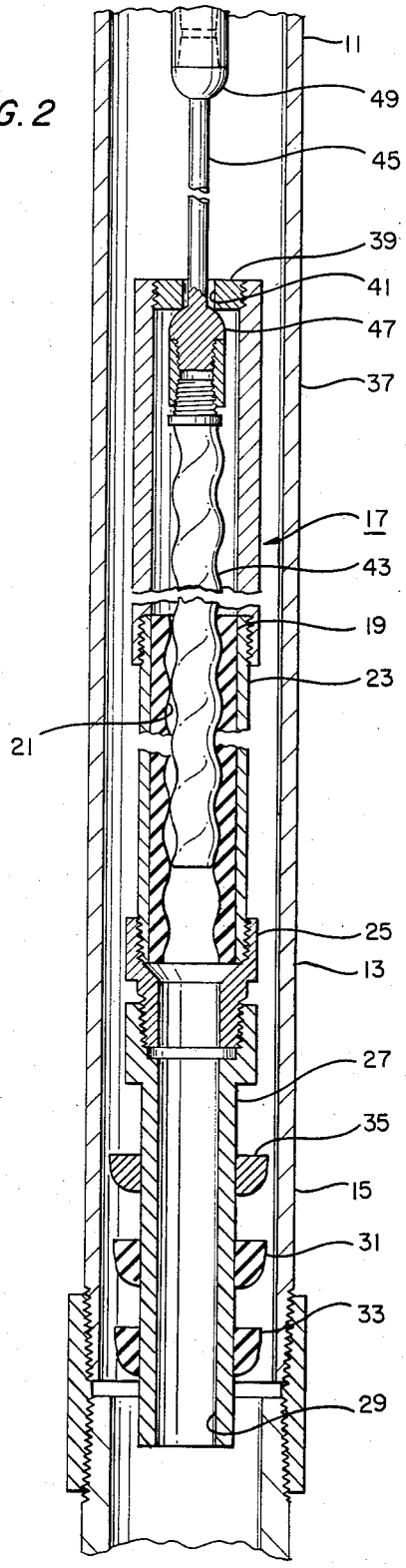
FIG. 2 is a view of the progressing cavity pump of FIG. 1, shown in an unseated position.

In operation, the seating nipple 13 will be secured to the lower end of the lowermost section of tubing 11. Then the tubing will be lowered into the well. After the tubing 11 is positioned, pump 17 is lowered into the tubing 11. Pump 17 is assembled with the seating member 27 mounted below the stator housing 23 and the drive rod 45 connected to the lowermost section of sucker rod 53. Pump 17 is lowered through the tubing 11 into the well with the sucker rod 53 supporting the pump 17, which is retained by collar 39 and coupling 47 contacting each other. The torque reactor cup 35 and seals 31 and 33 provide a clearance for fluid to be displaced as the pump 17 is lowered through the fluid in the well. While lowering into the well, a portion of the rotor 43 will still be located within stator 19, but a portion of the rotor 19 will be protruding above the stator 19, as shown in FIG. 2. Well fluid will not flow through the stator 19 while the pump 17 is being lowered into the well.

Eventually, the lower seal 33 will contact the seating nipple 13. The lowering of the sucker rod 53 is continued without rotation, causing the rotor 43 to move downward with respect to stator 19 and the upper coupling 49 to contact the collar 39. The weight of the string of sucker rods 53 will be transmitted through upper coupling 49 and collar 39 to housing 23 and seating member 27, pushing seals 31 and 33 into the seating nipple 13, and wedging the torque reactor cup 35 tightly into the seating nipple 13. When the upper coupling 49 is in contact with the restraining collar 39, the lower end of the rotor 43 will be protruding below the lower end of the stator 19. Once the seating member 27 is seated, the string of rods 53 is picked up a short distance while housing 23 remains stationary and seated, to initially space the top of rotor 43 several inches above the stator 19. The upper end of the string 53 is then secured to a conventional rotary power source (not shown) for rotation.

When the string 53 rotates, it rotates the rotor 43 to cause fluid to flow through the seating member 27 and out the stator 19 into the rotor nipple 37. The fluid flows out the aperture 41 in the annular clearance surrounding the drive rod 45. When the pumped fluid completely fills tubing 11 and begins to flow to lines or tanks at the surface, the weight of the well fluid causes the sucker rod string 53 to stretch. This lowers rotor 43 with respect to stator 19. However, prior to pumping, the top of rotor 43 was spaced above stator 19 a distance greater than the expected amount of stretch of sucker rods 53. Consequently, after full stretch, the top of rotor 43 is still above the top of stator 19, avoiding harmful interference. After stretching, the lower end of rotor 43 should be approximately flush with the lower end of stator 19, or it could protrude below.

When it becomes necessary to pull the pump 17 for maintenance, the string 53 is uncoupled from the motor at the surface. Then the string 53 is picked up to cause the lower coupling 47 to impact against the collar 39. The upward force should dislodge the seals 31 and 33 and the reactor cup 35 from the seating nipple 13. It may be necessary to place jars in the rod string 53 at the surface to deliver successive impacts to collar 39 to release the pump 17. Once released, the rod string is pulled to the surface, bringing along with it the pump 17. The tubing 11 and seating nipple 13 remain in the well.

The seating nipple 13 serves as an outer seating member, and the seating member 27 serves as an inner seating member. Seals 31 and 33 and reactor cup 35 serve as means for preventing rotation of the stator 19 and for sealing the seating member 27 in the seating nipple 13. The couplings 47 and 49 serve as flange means on the drive rod 45 for contacting the restraining member or collar 39. The couplings 47 and 49 and the collar 39 serve as engaging means for allowing vertical movement of drive rod 45 with respect to stator 19.

The invention has significant advantages. The invention allows the entire progressive cavity pump to be pulled to the surface without removing the tubing. This is a considerable savings in expense and equipment. The rotor remains in a proper alignment even through the rod string stretches.

While the invention has been shown in only one of its forms, it should be apparent to those skilled in the art that it is not so limited but is susceptible to various changes without departing from the scope of the invention.

I claim:

1. In a well containing a progressing cavity pump of the type having a stator, a helical rotor located in the stator and rotated by a string of sucker rods extending through tubing to the surface, an improved means for mounting the pump with the tubing, comprising in combination:

a tubular outer seating member secured to a lower end of the tubing;

a tubular inner seating member secured to a lower end of the stator for reception in the outer seating member, the seating members having cooperative means for preventing rotation of the stator and for sealing the inner seating member in the outer seating member, allowing well fluid to flow through the inner seating member to the stator;

a tubular rotor nipple secured to an upper end of the stator and having a restraining member therein with an aperture therethrough;

a drive rod extending through the rotor nipple and the aperture of the restraining member, having a lower end secured to the rotor below the restraining member and an upper end secured to the sucker rods above the restraining member; and upper and lower flange means on the drive rod of larger diameter than the aperture and spaced above and below the restraining means for allowing vertical movement of the drive rod with respect to the stator between a lower position in which the weight of the sucker rods is transmitted to the stator housing through contact of the upper flange means on the restraining means to cause the seating members to seat within one another, to an upper position in which the lower flange means contacts the lower side of the restraining means to pull the inner seating member from the outer seating member to remove the stator and rotor.

2. In a well containing a progressing cavity pump of the type having a stator, a helical rotor located in the stator and rotated by a string of sucker rods extending through tubing to the surface, an improved means for mounting the pump within the tubing, comprising in combination:

a tubular outer seating member secured to a lower end of the tubing;

a tubular inner seating member secured to a lower end of the stator for reception in the outer seating member, the seating members having cooperative means for preventing rotation of the stator and for sealing the inner seating member in the outer seating member, allowing well fluid to flow through the inner seating member to the stator;

a tubular rotor nipple secured to an upper end of the stator and having a restraining member therein with an aperture therethrough; and a drive rod extending loosely through the aperture, having a lower end secured below the restraining member to the rotor and an upper end secured above the restraining member to the sucker rods;

the drive rod having upper and lower flange means thereon of larger diameter than the aperture and spaced above and below the restraining means, respectively, a distance greater than the amount of stretch in the string of sucker rods that is expected to occur during pumping operations.

3. A method of installing a progressing cavity pump assembly within a well, the pump assembly being of the type having a stator, a helical rotor located in the stator and rotated by a string of sucker rods extending through tubing to the surface, comprising:

securing a tubular seating member to a lower end of the tubing and lowering the tubing into the well;

mounting a seating member on a lower end of the pump assembly;

mounting a rotor nipple to the upper end of the stator and a drive rod to the upper end of the rotor, and providing the rotor nipple and drive rod with engaging means that allows a selected amount of vertical movement of the rotor with respect to the stator;

connecting the upper end of the drive rod to the sucker rods;

lowering the pump assembly into the tubing on the sucker rods until the seating member on the pump assembly contacts the tubular seating member;

continuing to lower the sucker rods without rotation, moving the rotor downward with respect to the stator and forcing the seating members together with the weight of the sucker rods applied to the stator through the engaging means; then moving the sucker rods and the rotor a selected distance upward while the stator remains stationary to position the top of the rotor above the stator a selected distance; then connecting the sucker rods at the surface to a rotary power source and rotating the sucker rods to cause the pump to operate.

4. In a well containing a progressing cavity pump of the type having a stator, a helical rotor located in the stator, an improved means for mounting the pump within a string of tubing in a well, comprising in combination:

a string of sucker rods extending through the tubing;

a tubular outer seating member secured to a lower end of the tubing;

a tubular inner seating member secured to a lower end of the stator for reception in the outer seating member, the seating members including a wedge-shaped reactor cup for wedging the inner seating member into the outer seating member, the seating members also having seal means for sealing the inner seating member in the outer seating member, allowing well fluid to flow through the inner seating member to the stator;

a tubular rotor nipple secured to an upper end of the stator;

a drive rod extending through the rotor nipple, having a lower end secured to the rotor and an upper end secured to the sucker rods; and engaging means on the drive rod and the rotor nipple for allowing vertical movement of the drive rod with respect to the stator between a lower position in which the weight of the sucker rods is transmitted to the stator housing to cause the seating members to seat within one another, to an upper position in which the upper end of the rotor is spaced above the upper end of the stator.

* * * * *

UNITED STATES PATENT AND TRADEMARK OFFICE

CERTIFICATE OF CORRECTION

PATENT NO. : 4,592,427

DATED : June 3, 1986

INVENTOR(S) : Arvid Eugene Morgan

It is certified that error appears in the above-identified patent and that said Letters Patent is hereby corrected as shown below:

Column 4, line 32, 35 and 62, "restraining means" should read -- restraining member --.

Signed and Sealed this

Twenty-fifth Day of November, 1986

*Attest:*

DONALD J. QUIGG

*Attesting Officer*

*Commissioner of Patents and Trademarks*